United States Patent [19]

Orban

[11] Patent Number: 4,634,805

[45] Date of Patent: Jan. 6, 1987

[54] CONDUCTIVE CABLE OR FABRIC

[75] Inventor: Ralph F. Orban, Columbus, Ohio

[73] Assignee: Material Concepts, Inc., Columbus, Ohio

[21] Appl. No.: 729,774

[22] Filed: May 2, 1985

[51] Int. Cl.[4] ..... H01B 5/08

[52] U.S. Cl. ..... 174/128 R; 174/122 C; 174/126 C; 174/129 R; 174/131 A; 428/381; 428/394

[58] Field of Search ..... 174/122 C, 124 GC, 126 C, 174/126 CP, 128 R, 129 R, 130, 131 R, 131 A, 131 B; 428/379, 381, 394, 902

[56] References Cited

U.S. PATENT DOCUMENTS

| | | | |
|---|---|---|---|
| 3,240,570 | 3/1966 | Grimes, Jr. et al. | 174/128 R |
| 3,980,808 | 9/1976 | Kikuchi et al. | 174/131 A |
| 4,097,686 | 6/1978 | Gladenbeck | 174/113 R X |
| 4,176,905 | 12/1979 | Marechal | 174/128 R X |
| 4,247,596 | 1/1981 | Yee | 428/394 X |
| 4,267,233 | 5/1981 | Tanaka et al. | 428/394 X |
| 4,303,733 | 12/1981 | Bulle et al. | 174/126 CP X |
| 4,399,322 | 8/1983 | Hafner, Jr. | 174/131 A X |
| 4,518,632 | 5/1985 | Jones | 428/902 X |

FOREIGN PATENT DOCUMENTS

| | | | |
|---|---|---|---|
| 1081072 | 12/1954 | France | 174/126 CP |
| 1235002 | 5/1960 | France | 174/130 |
| 10129 | 5/1893 | United Kingdom | 174/128 R |
| 1179090 | 1/1970 | United Kingdom | 174/128 R |

*Primary Examiner*—Arthur T. Grimley
*Assistant Examiner*—Morris H. Nimmo
*Attorney, Agent, or Firm*—John L. Gray

[57] ABSTRACT

A conductive cable made up of a plurality of polyaramid elements referred to as tows, which are woven, twisted, or braided together, in which each of said tows comprises a large number of individual fine filaments (usually about 1,000 or so) with each of the individual filaments being coated with an adherent metal coating such as copper, nickel, silver, zinc, cadmium, platinum, iron, cobalt, chromium, tin, lead, rhodium, ruthenium, and indium in single or multiple layers so as to provide strength and good electrical conductivity. Woven polyaramid fabric is also disclosed with the individual filaments in each element or tow of the fabric having been treated in the same manner.

Methods of making such a cable or woven fabric are also disclosed.

7 Claims, 4 Drawing Figures

CONDUCTIVE CABLE OR FABRIC

BACKGROUND OF THE INVENTION

Current conductive underwater cable consists of a copper electrical conductor and a polyaramid strength member, either as jacketing or wrapping. Because of the dissimilar properties of the copper and the polyaramid coating, when extreme stress is applied to the cable assembly the differences in the load elastic characteristics provide different recovery responses and thus cause z-kinking. The ultimate result can be the rupture of the polyaramid jacketing by the copper conductor because after the load is released the polyaramid jacket returns to nearly the original length, while the copper wire remains elongated. This causes the wire to rupture the jacket, weaken the assembly, and short out the electrical connection.

SUMMARY OF THE INVENTION

This invention involves a combination metal polyaramid cable assembly where the cable is made up of a number of elements or tows of polyaramid fine filaments in substantially straight, parallel, untwisted relationship to each other. Each of said filaments are completely coated with a conductive metal and the tows may be woven, twisted, or braided together to provide a cable of the desired size. Thus following application and release of load, the cable will return to its original length without damage to the polyaramid portion of the cable. Such a cable may be used in underwater applications and also may be used as a space tether.

The invention also contemplates the production of woven polyaramid cloth made of individual elements or tows in which the individual filaments in the tows are electrically conductive.

It is therefore an object of this invention to provide such a fabric.

It is therefore also an object of this invention to provide a multi-filament, multi-tow electrically conducting cable which will not cause rupture between the polyaramid and metal conductor in which the polyaramid and the metal will not result in different recovery responses upon the application of varying loads.

It is a further object of this invention to provide such a cable that may be useful in underwater and space tether applications.

It is another object of this invention to provide a method of making such a cable.

These, together with other objects and advantages of the invention, should become apparent in the details of construction and operation, as more fully described herein and claimed, reference being had to the accompanying drawing forming a part hereof wherein like numerals refer to like parts throughout.

DETAILED DESCRIPTION OF THE INVENTION

Figure 1:
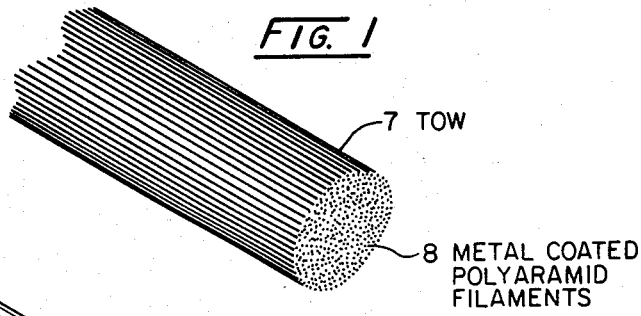
FIG. 1 is a perspective view of a tow showing the individual filaments.

Referring now more particularly to FIG. 1, a multi-filament tow 7 is shown containing individual filaments 8 made from polyaramid. Typically the mutli-filament tow 7 will contain about 1,000 or more individual filaments 8, and each filament is 11.9 microns thick (25.4 microns equal 0.001 inch).

Figure 2:
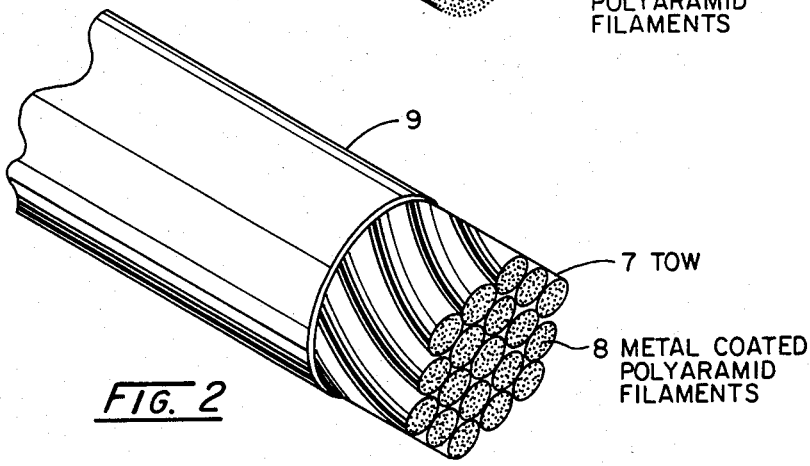
FIG. 2 is a perspective view of a cable made from a number of individual tows twisted together.

Referring now more particularly to FIG. 2, the plurlaity of tows 7 is shown twisted together to form a conductive cable after the individual filaments 8 of each tow 7 have been coated with a conductive metal. The twisted plurality of two 7 may be covered with a non-conductive or electrically insulating jacketing or coating 9 to protect the system from seawater or the earth's upper atmosphere space environment. For space environments, the coating preferably would be a fluorine containing polymer or copolymer such as the copolymer of chlorotrifluoroethylene and vinylidene fluoride, which has the tradename "Kel-F". This material is fairly elastic and insulates the conductive polyaramid from its environment. For seawater applications, a rubberized insulating coating may be used.

Figure 3:
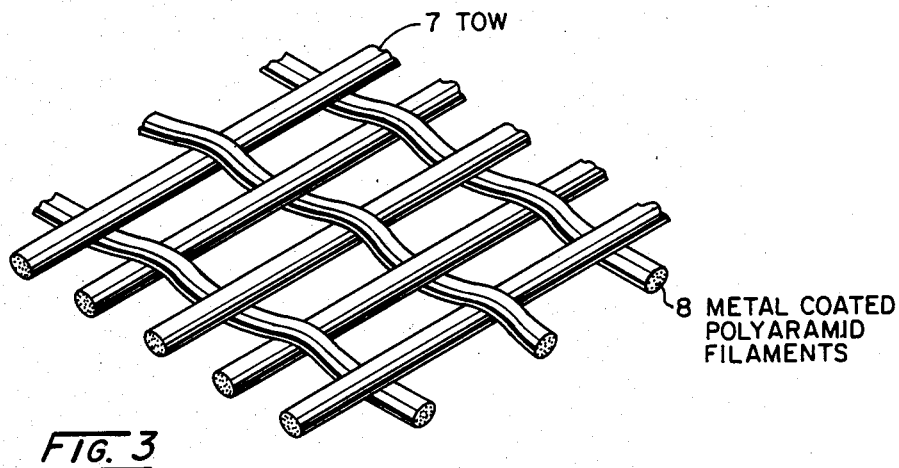
FIG. 3 is a magnified view of a fabric woven from individual tows.

Referring now more particularly to FIG. 3, there is shown an enlarged magnified perspective view of a fabric made from a number of tows 7 wherein the individual filaments 8 of each tow 7 have been coated with metal in accordance with this invention. Depending upon the application, the tows 7 may be processed separately to have their individual filaments 8 coated with metal or the finished fabric may be treated to coat the individual filaments 8 in each of the tows 7 with metal.

Figure 4:
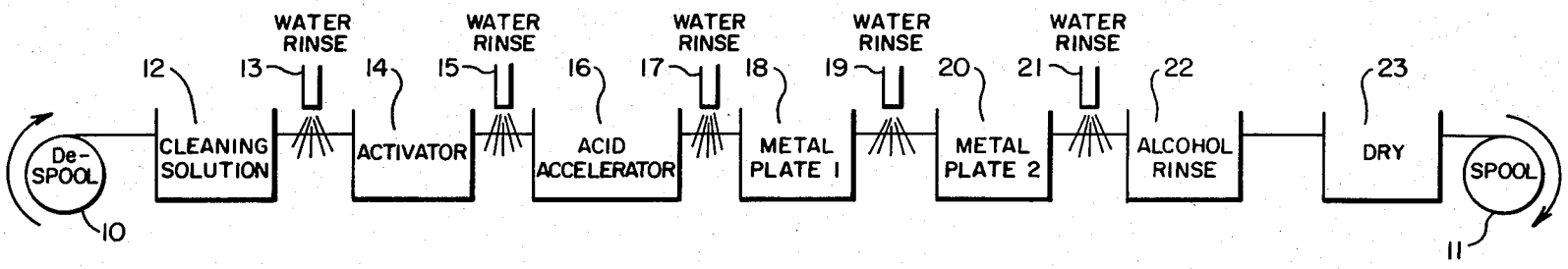
FIG. 4 is a schematic showing the process steps of preparing the cable or fabric of the invention.

Referring now more particularly to FIG. 4, a mutli-filament tow 7 of polyaramid filaments 8 is wound on spool 10 from which it is unwound as a result of the winding action of spool 11 at the opposite end of the system. In some cases the polyaramid tow 7 is manufactured with a light sizing. Depending upon the type of sizing, its presence can interfere with the metal coating process. In such case, it is necessary to clean the tow 7 prior to performing the metal coating process, and the tow 7 then initially enters the cleaning solution 12 comprising warm sodium hydroxide or a chlorinated solvent or mixtures thereof. The tow 7 is then submitted to a water rinse shown at 13. If the polyaramid tow 7 is not provided with such a protective coating, the cleaning step 12 and the subsequent water rinse 13 may be omitted. The tow 7 then enters activator 14 containing palladium chloride and/or tin chloride. Following this the tow 7 is submitted to a water rinse 15 and then introduced into the acid accelerator 16 of the usual commercial type, following which the tow 7 is again submitted to a water rinse 17 and then introduced into the first metal plating bath 18 which metal may consist of copper, gold, cobalt, nickel, or palladium and the process used may be autocatalytic coating, electroplating, or immersion plating. The tow 7 is then submitted to a water rinse 19. Second metal plating bath 20 may be omitted, as would be the water rinse 21 in that case, and the tow 7 may be led directly to the alcohol rinse 22. On the other hand, in order to provide for a larger build-up of metal on the individual filaments 8 it is preferable to introduce the tow into the second metal plating bath 20 in which case the bath may plate the same type of metal, i.e., copper, gold, cobalt, nickel, or palladium, as has been plated on the individual filaments in the tow 7 in metal plating bath 18, or the metal plating may consist of a metal selected from the group consisting of copper, nickel, silver, zinc, cadmium, platinum, iron, cobalt, chromium, tin, lead, rhodium, ruthenium, and indium. The process used may be autocatalytic coating, electroplating, or immersion plating. This step is followed by water rinse 21, alcohol rinse 22, and oven drying 23 before the tow is spooled onto spool 11.

The coating system of choice involves two coats of copper with a third light coating of nickel in order to retard copper oxidation. Once the multi-filament tows 7 are fully coated, a number of them are woven, twisted, or braided to carry the desired load. Of course, electrical conductivity is directly related to the number of tows 7 in the resulting cable.

The method of making the cable or fabric may be more fully understood by reference to the following examples.

In each of these examples the fiber transport system was set to produce the desired resident times in the various solutions. A 1,000 filament polyaramid tow was used.

Cleaning solution 12 for one minute, comprising warm sodium hydroxide and/or chlorinated solvent.

Water Rinse 13.

Activator 14 for two minutes. A commercial palladium chloride/stannus chloride catalytic solution comprising the catalyst, water, and hydrochloric acid may be used.

Water Rinse 15.

Acid accelerator 16 for two minutes. This comprises a 50 percent hydrochloric acid/water mixture.

Water Rinse 17.

Metal plating process 18 for 10 to 20 minutes. A commercial, autocatalytic copper bath is used containing 1.25–2.75 grams/liter of copper; 11–18 grams/liter of hydroxide; 5.6–8.8 grams/liter of 37 percent formaldehyde; temperature 70°–90° F.; pH 12–13.

Water Rinse 19.

Metal plating bath 20 for two minutes. A cyanide copper high-speed bath may be used containing 80 grams/liter of copper cyanide; 100 grams/liter of sodium cyanide; 20 grams/liter of potassium hydroxide.

Water Rinse 21.

Alcohol Rinse for one minute.

Drying 23.

EXAMPLE 1

The polyaramid tow 7 was treated in accordance with the above and after drying, the polyaramid tow 7 fiber was found to have an electrical resistance of 0.5 ohms per foot. Each of the 1,000 filaments was uniformly coated with a bright, shiny, adherent copper deposit. The coated polyaramid tow 7 was still flexible and ductile, and exhibited an overall decrease in break load strength of only 8–12 percent.

EXAMPLE 2

The same conditions as in Example 1 were followed except that a third metal coating of nickel was applied, following the water rinse 21 and prior to the alcohol rinse. The nickel bath used was a typical commercial sulfamate nickel bath comprised of nickel sulfamate containing 43.6 oz/gallon and poric acid of 4.0 oz/gallon. The resultant coated polyaramid tow 7 was similar to that produced in Example 1 except that it was nickel-coated and had an electrical resistance of less than 1.0 ohms per foot.

EXAMPLE 3

The same conditions were followed as above except that the first metal deposited on the polyaramid filaments B was nickel and the second was copper. The nickel was deposited from an autocatalytic bath comprised of nickel sulfate/nickel chloride, sodium hypophosphite, diethylamine borane, citric acid, and thiourea at a temperature of 150° F. The copper was deposited from the copper cyanide bath in Example 1. The resultant coated polyaramid tow 7 was similar to that produced in Example 1 and had an electrical resistance of less than 1 ohm per foot.

Thus it will be seen that a conductive cable or woven cloth of polyaramid with the individual filaments coated with a conductive metal is disclosed as is its method of manufacture. A cable thus made has application in underwater usage and as a space tether. Such a cable will not degenerate under varying loads, since the electrical conductive component is also the load-carrying component of the system.

While this invention has been described in its preferred embodiment, it is appreciated that variations thereon may be made without departing from the true scope and spirit of the invention.

What is claimed is:

1. A conductive cable comprising a plurality of polyaramid tows, each of said tows comprising a multiplicity of individual filaments in substantially straight parallel untwisted relationship to each other, each of said filaments being coated with an adherent metal coating, said tows being combined together.

2. The cable of claim 1 wherein said metal forming said coating is selected from the group consisting of copper, nickel, gold, palladium, and cobalt.

3. The cable of claim 2 wherein said metal coating comprises a plurality of layers of metal, all layers consisting of the same metal.

4. The cable of claim 1 wherein said adherent metal coating comprises a first coating on each of said filaments selected from the group consisting of copper, nickel, gold, palladium, and cobalt and a second metal coating on said first coating selected from the group consisting of copper, nickel, silver, zinc, cadmium, platinum, iron, cobalt, chromium, tin, lead, rhodium, ruthenium, and indium.

5. The cable of claim 2 wherein said adherent metal coating comprises a first coating of copper, a second coating of copper over said first coating of copper, and a coating of nickel over said second coating of copper.

6. The conductive cable of claim 1 wherein said tows are braided together.

7. The conductive cable of claim 1 wherein said tows are twisted together.

* * * * *